US006050004A

United States Patent [19]

Miralles et al.

[11] Patent Number: 6,050,004

[45] Date of Patent: Apr. 18, 2000

[54] MULTIPLE-SIZE SPORTS BOOT

[75] Inventors: Thierry Miralles, Lombard; Raphael Reiller, Claven, both of France

[73] Assignee: Salomon S.A., Metz-Tessy, France

[21] Appl. No.: 09/079,856

[22] Filed: May 15, 1998

[30] Foreign Application Priority Data

May 16, 1997 [FR] France ..... 97 06358

[51] Int. Cl.[7] ..... A43G 3/26

[52] U.S. Cl. ..... 36/97; 36/102; 36/105

[58] Field of Search ..... 36/97, 100, 102, 36/105, 8.2

[56] References Cited

U.S. PATENT DOCUMENTS

| | | | |
|---|---|---|---|
| 3,963,252 | 6/1976 | Carlson | 280/11.22 |
| 4,120,103 | 10/1978 | Colby | 36/97 |
| 4,408,403 | 10/1983 | Martin | 36/115 |
| 4,418,929 | 12/1983 | Gray | 280/11.23 |
| 4,704,808 | 11/1987 | Bianchini et al. | 36/102 |
| 4,852,275 | 8/1989 | Bianchini et al. | 36/102 |
| 5,069,462 | 12/1991 | Murga | 280/23 |
| 5,125,172 | 6/1992 | Iwama et al. | 36/117 |
| 5,171,033 | 12/1992 | Olson et al. | 280/11.22 |
| 5,177,884 | 1/1993 | Rullier | 36/117 |
| 5,193,827 | 3/1993 | Olson | 280/7.13 |
| 5,276,983 | 1/1994 | Hatfield | 36/138 |
| 5,331,752 | 7/1994 | Johnson et al. | 36/115 |
| 5,339,543 | 8/1994 | Lin | 36/101 |
| 5,357,695 | 10/1994 | Lu | 36/115 |
| 5,437,466 | 8/1995 | Meibock et al. | 280/11.22 |
| 5,475,936 | 12/1995 | Cavasin | 36/115 |
| 5,499,461 | 3/1996 | Danezin et al. | 36/117 |
| 5,570,523 | 11/1996 | Lin | 36/112 |
| 5,842,293 | 12/1998 | Young | 36/97 |

FOREIGN PATENT DOCUMENTS

| | | | |
|---|---|---|---|
| 302731 | 4/1997 | China . | |
| 0261756 | 3/1988 | European Pat. Off. . | |
| 0765614 | 4/1997 | European Pat. Off. . | |
| 0770339 | 5/1997 | European Pat. Off. . | |
| 2668072 | 4/1992 | France . | |
| 174665 | 9/1906 | Germany | 36/97 |
| 296 00 910 U | 5/1996 | Germany . | |
| WO94/21149 | 9/1994 | WIPO . | |

*Primary Examiner*—Paul T. Sewell
*Assistant Examiner*—Jila Mohandesi
*Attorney, Agent, or Firm*—Greenblum & Bernstein, P.L.C

[57] ABSTRACT

A sport boot adapted in particular to gliding on snow, ice or hard ground, having an outer sole adapted to be made integral with a gliding member if necessary, and from which an upper extends to cover the skater's foot, wherein the boot has two parts, the first of which, made from a relatively rigid material, constitutes a cradle forming a rear envelope adapted to house the skater's heel and extending forward to constitute the sole, which is adapted to be made integral, during assembly, with a second part, made from a relatively flexible material, constituting a vamp covering the skater's forefoot, having a plantar support, that is nested then respectively connected to the cradle by fixed connecting elements that are implemented after a relative adjustment of the vamp in the longitudinal direction with respect to said cradle, between at least two positions corresponding to at least two successive sizes, the vamp furthermore including deformation zones allowing its nesting in the cradle.

22 Claims, 3 Drawing Sheets

MULTIPLE-SIZE SPORTS BOOT

BACKGROUND OF THE INVENTION

1. Field of the Invention

The present invention relates, in a general way, to a sports boot, including for example, a gliding sport or other sport requiring the transmission of specific forces. More specifically, the present invention relates to a boot adapted to skiing on snow, ice skating, or skating on hard ground. In these cases, a gliding member is attached beneath the sole of the boot to transform it into an ice skate, a traditional roller skate, or an in-line roller skate.

2. Descrption of Background and Relevant Information

For boots of the aforementioned type, the external sole is made integral with the upper plate of a frame, on which the wheels are arranged, and from which an upper extends, covering the foot and extending in the direction of the skater's ankle.

One of the problems found in this type of boot lies in the fact that it is generally designed according to the techniques of alpine ski boots, i.e., having a one-piece shell made from a relatively rigid plastic material.

However, it has been observed, especially for in-line roller skating, that there is a decrease in shell rigidity caused by higher temperatures in this field of application, since this sport is practiced primarily in good weather. This phenomenon is accentuated further in regions with high temperatures.

This loss of shell rigidity is an essential criterion for the good transmission of forces and a good stability. Of course, it is possible to stiffen this shell in a general way, by making it from a material with a higher flexural modulus, but it would be at the expense of comfort and the enveloping qualities of the foot.

To overcome the aforementioned disadvantage, commonly owned French patent application No. 96.09054, and U.S. patent application No. 08/887,945, have proposed a sports boot in which the upper is composed of two parts, the first part being made from a relatively stiff material constituting a cradle, and the second part being made from a relatively flexible material constituting a vamp.

This construction allows for a compromise between the comfort and stiffness necessary in certain parts of the shoe.

Although such a design provides a solution to the above-cited problems, it in turn has the disadvantage of increasing the number of parts due to the fact that the upper is made of two parts.

Furthermore, it can be easily understood that it will be necessary to make two parts of different lengths for each boot size. Making such parts in plastic material calls for very expensive special tools.

SUMMARY OF THE INVENTION

An object of the present invention is thus to provide an improved construction for a boot of the above-mentioned type, which allows standardizing and reducing the number of parts necessary and thereby decreasing the costs.

In order to obtain this objective, it is envisioned in a first phase of the inventive process to make two identical parts that could be adapted to a range of different sizes, and at least two successive sizes.

Thus, the above-mentioned disadvantage is compensated in that there is a substantial reduction in the number of parts and thereby of tools, depending on the sizes.

This objective is thus obtained by this invention which relates, to this end, to a sports boot, especially for gliding sports, having an outer sole adapted to be made integral with a gliding member if necessary, and from which an upper extends to cover the skater's foot, the boot having two parts, the first being made from a relatively rigid material, constituting a cradle forming a rear envelope adapted to house the skater's heel and extending forward to constitute the sole, which is adapted to be made integral, during assembly, with a second part, made from a relatively flexible material, constituting a vamp covering the skater's forefoot, and having a plantar support that is nested, then respectively connected to the cradle by fixed connecting means that are implemented after a relative adjustment in the longitudinal direction of the vamp with respect to the cradle, between at least two positions corresponding to at least two successive sizes L, L', the vamp furthermore having deformation zones allowing it to be nested in the cradle.

The invention also relates to the characteristics that will emerge throughout the following description and which should be considered separately or according to all their possible technical combinations.

BRIEF DESCRIPTION OF DRAWINGS

This description, given by way of a non-limiting example, will provide a better understanding of how the invention can be obtained, by referring to the annexed drawings wherein.

DETAILED DESCRIPTION OF THE INVENTION

Figure 1:
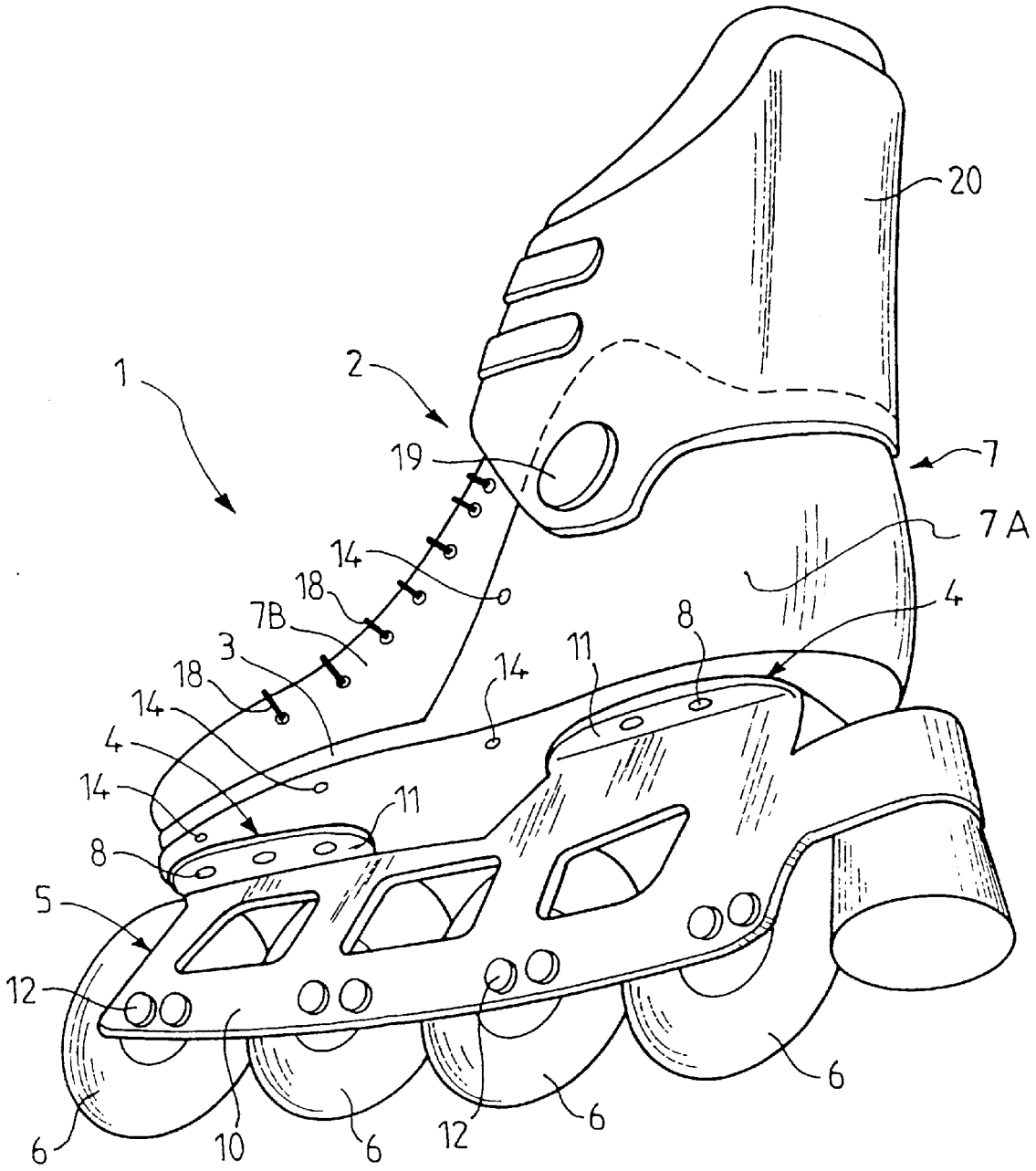
FIG. 1 is a perspective view of an in-line roller skate, cited by way of example, and of a boot associated according to the invention.
Figure 2:
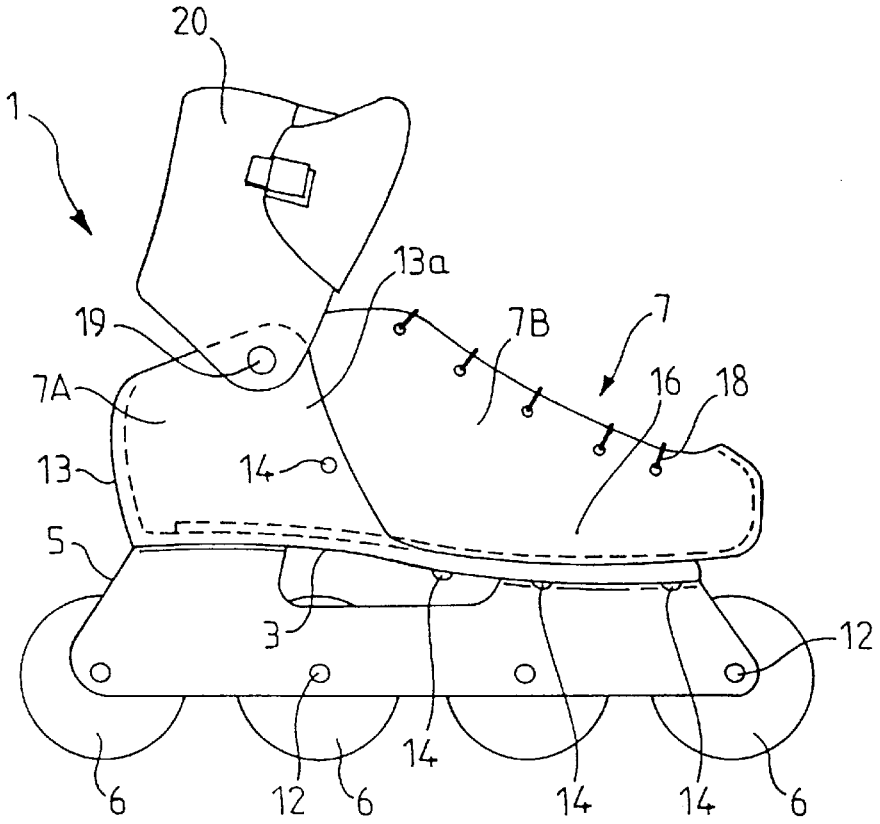
FIG. 2 is a lateral view of a boot and a skate according to FIG. 1 corresponding to one embodiment of the boot.
Figure 3:
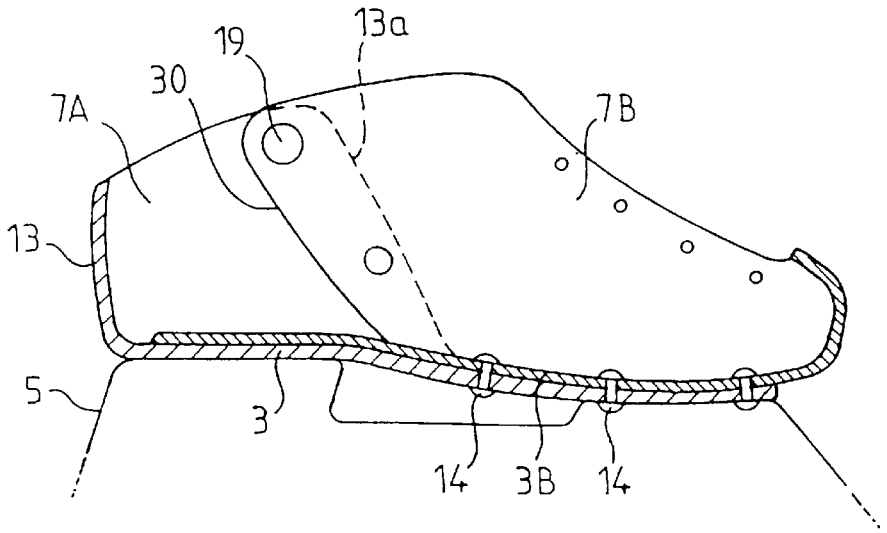
FIG. 3 is a lateral view of a boot according to the embodiment of FIG. 2.
Figure 4:
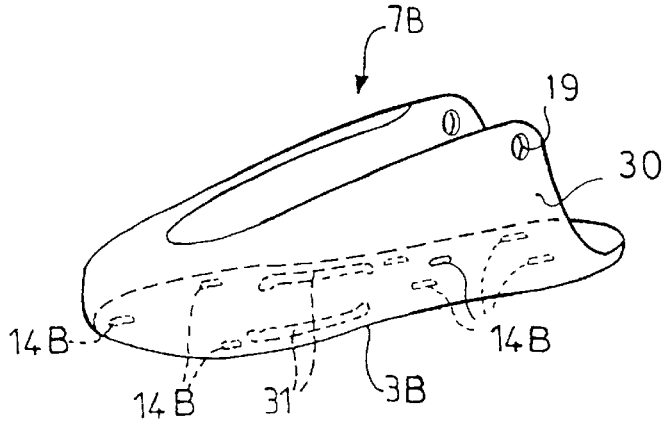
FIGS. 4 and 5 show, in an exploded perspective, the two parts of the upper 7, namely the vamp and the cradle, respectively, before assembly.
Figure 5:
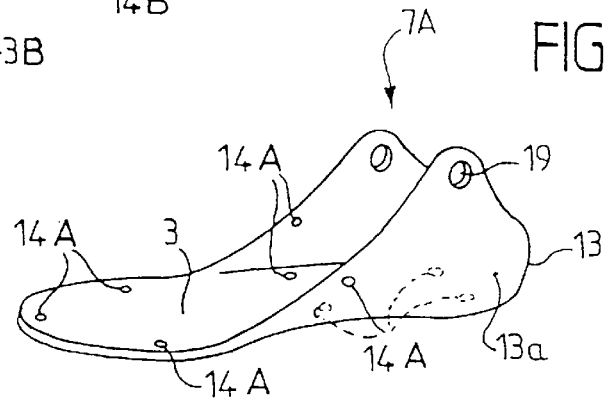

The in-line roller skate 1, designated in its entirety and shown in FIG. 1, has a boot 2 constituted of an external sole 3, adapted to be made integral with the upper plate 4 of a frame 5 on which are arranged the wheels 6 and the sole 3 from which an upper 7 extends, covering the entire foot and extending in the direction of the skater's ankle.

The sole 3 of the boot 2 is made integral with the upper horizontal plate 4 by attachment means or elements, in this case, screws 8 that extend through the plate 4 in order to be screwed into the lateral edges of the sole 3.

The frame 5 also has a lower portion, perpendicular to plate 4, with respect to its longitudinal axis, which, for example, is constituted by two vertical lateral wings 10, parallel to one another and arranged on either side of the longitudinal axis of the frame.

The lateral wings 10 are extended, at their upper parts respectively, by a perpendicular return 11, each one being directed towards the outside and constituting a plane corresponding to the horizontal plate 4.

In this way, the vertical lateral wings 10 generally define, with the sole 3 of the boot 2, an inverted U, between the wings of which a plurality of wheels 6 are arranged, for example, four, by the transverse journal axles 12, affixed to the frame 4, so as to constitute a rolling train.

The boot is composed of two parts, the first, forming a cradle 7A, is made from a relatively rigid material defining a rear envelope 13, equipped with lateral parts 13*a*, which is adapted to house the skater's heel and which extends forward to constitute the sole 3.

The sole is adapted to be affixed, during assembly, to a second constitutive part 7B of the upper 7, made from a relatively flexible material, so as to constitute a vamp covering the instep of the skater's foot.

The vamp 7B has a plantar support 3B and lateral parts 30, which are capable of being nested, then respectively of being connected to the cradle 7A, by the sole 3 and the lateral zones 13*a* thereof, which thus partially overlap with the lateral parts 30 of the vamp 7B.

The attachment of the two parts 7A, 7B is achieved by the connecting means or elements 14 which are fixed and implemented after the relative "telescopic" adjustment in the longitudinal direction, of the vamp 7B with respect to the cradle 7A, between at least two positions corresponding to at least two successive sizes L, L'. During this adjustment, the plantar support zone 3B is deformed in the transverse direction and adapts to the transverse dimensions of the cradle 7A by virtue of the deformation of the least resistance zones 31 made in the plantar support 3B of the vamp 7B, interior of the lateral zones 13*a* of the cradle 7A.

Figure 6:
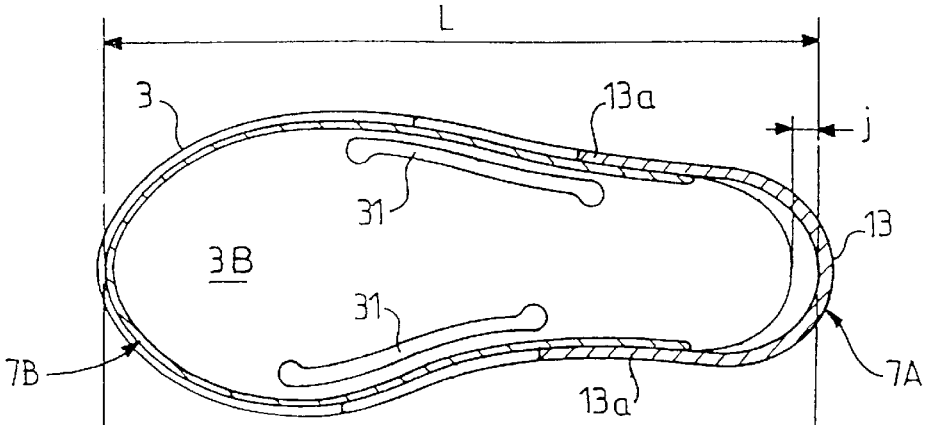
FIGS. 6 and 7 show, in top and sectional views, the relative positioning of a vamp in the cradle, according to any given size and an at least immediately smaller size, respectively.
Figure 7:
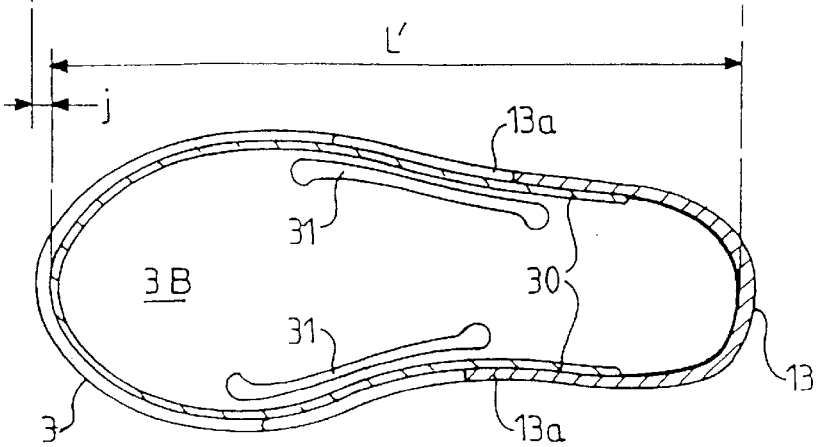

As shown quite clearly in FIGS. 6 and 7, the zones of least resistance 31 are constituted by slots generally extending in the longitudinal direction of the sole 3 and located near the lateral edges of the plantar support 3B of the vamp 7B. These slots 31 thus allow an elastic deformation of the plantar support 3B in the transverse direction when it passes between the lateral zones 13*a* of the cradle 7A while nesting, so as to be adapted to the narrow interval defined between the lateral parts 30.

The deformable slots 31 of the vamp 7B are of a length and width so as to allow their elastic deformation during assembly into the cradle 7A.

FIGS. 6 and 7 also show that the relative position of the vamp 7B with respect to the cradle 7A is provided to allow, in a longitudinal direction, a clearance j between the rear end of the vamp 7B and the internal edge of the rear envelope 13 of the cradle 7A in a position corresponding to a given size L, and to eliminate this clearance j for a selected size L', at least immediately smaller.

Once the desired size is selected by an adequate positioning of the vamp 7B in the cradle 7A, the connecting means 14 are introduced.

These are inserted, on the one hand, between a lower and lateral peripheral edge of the vamp 7B and a corresponding shoulder of the cradle 7A, and, on the other hand, between the lateral edges 13*a* of the envelope 13 of the cradle 7B and the lateral parts 30 of the vamp 7A.

According to this embodiment, the connecting means 14 are constituted by rivets extending through the holes 14A, 14B made across from the vamp 7B and the cradle 7A, and the connecting means from the one vamp 7B or from the other vamp 7A are longitudinal oblong slots capable of allowing their relative movement during assembly.

It is to be understood that the rivets 14 previously mentioned could very well be replaced either by glue, weld seams, or stitches, the relative positioning of the parts being achieved before the implementation of these connecting means.

According to the present embodiment of, the envelope 13 of the heel of the cradle 7A is extended by lateral zones 13*a* on which are arranged, in the area of the malleoli, the journal axles 19 of a collar 20 for tightening the lower part of a skater's leg, extending upward by the extension of the upper 7 on which it is fixed.

The collar 20 could also be obtained by an extension of the upper part of the vamp 7B extending upwardly, beyond the skater's malleoli, while remaining journalled on the lateral zones 13*a* of the envelope 13 of the cradle 7A as previously mentioned.

By way of an example of the invention, the vamp 7B could be obtained from a relatively flexible material constituted by a fabric, the latter being constituted of a thick mesh forming a net. Also, by way of example, the cradle 7A can be made from a rigid plastic material.

An internal comfort element, not shown, can be introduced into the upper 7; it could be a detachable, one-piece liner.

The invention is not limited to the particular embodiment previously described by way of a non-limiting example, and encompasses all possible equivalent embodiments.

This is how, for example, the deformation zones of the vamp could be obtained in another manner without, however, leaving the scope of the invention.

This instant application is based upon French priority patent application No. 97/06358, filed on May 16, 1997, the disclosure of which is hereby expressly incorporated by reference thereto, and the priority of which is hereby claimed under 35 USC 119.

What is claimed is:

1. A sports boot comprising:

an external sole adapted to be affixed to a gliding member;

an upper extending upwardly from said sole for covering a user's foot;

said external sole and said upper comprising a first part comprising a first material and a second part comprising a second material, said first material being more rigid than said second material, said second material being more flexible than said first material;

said first part, constituting a cradle, forming a rear envelope to house the user's heel and extending forwardly to constitute said sole;

said second part, constituting a vamp, including a portion to cover the user's forefoot and a plantar support;

said vamp being nested with said cradle in a determinate position between at least two positions corresponding to at least two successive boot sizes;

a connection arrangement to connect said vamp to said cradle in said determinate position; and said vamp including deformation zones positioned in said plantar support of said vamp, said deformation zones, comprised of said second material, being adapted to deform during said nesting of said vamp with said cradle, comprised of said first material, in said determinate position.

2. A boot according to claim 1, wherein:

said deformation zones are constituted by generally longitudinally extending slots near lateral edges of said plantar support of said vamp, allowing transverse elastic deformation upon nesting of said vamp within said cradle.

3. A boot according to claim 2, wherein:

said slots, in said second material, allow elastic deformation of said plantar support during assembly into said cradle.

4. A boot according to claim 1, wherein:

said vamp has a rear end and said rear envelope of said cradle has an internal edge;

a clearance is provided between said rear end of said vamp and said internal edge of said rear envelope of said cradle in a longer one of said at least two successive boot sizes; and said clearance is eliminated between said rear end of said vamp and said internal edge of said rear envelope of said cradle in a shorter one of said at least two successive boot sizes.

5. A boot according to claim 1, wherein:

said vamp includes a lower and lateral peripheral edge and a pair of opposed lateral parts;

said cradle includes a shoulder and said rear envelope of said cradle includes lateral edges; and said connection arrangement includes means for connecting said lower and lateral peripheral edge of said vamp and said shoulder of said cradle and for connecting said lateral edges of said rear envelope of said cradle and said lateral parts of said vamp.

6. A boot according to claim 1, wherein:

said connection arrangement comprises glue.

7. A boot according to claim 1, wherein:

said connection arrangement comprises weld seams.

8. A boot according to claim 1, wherein:

said connection arrangement comprises stitches.

9. A boot according to claim 1, wherein:

said connection arrangement comprises:

elongated slots in at least one of said vamp and said cradle;

openings in at least one of said vamp and said cradle; and rivets extending through respective ones of said slots and said openings to secure said vamp to said cradle in said determinate position.

10. A sports boot comprising:

a cradle comprising a rear envelope to house the user's heel, said rear envelope including lateral zones extending upwardly to a malleoli area and a rear portion extending between said lateral zones, said cradle further comprising a sole extending from said rear portion of said rear envelope forwardly beyond said lateral zones of said rear envelope;

a vamp comprising a portion to cover the user's forefoot and including lateral zones extending from a forward end of said vamp to the malleoli area, said vamp further comprising a plantar support positioned upon said sole of said cradle;

said cradle comprising a first material being relatively more rigid than a second material of which said vamp is comprised, said second material of which said vamp is comprised being relatively more flexible than said first material of which said cradle is comprised;

said vamp and said cradle being nested together in a determinate position between at least two positions corresponding to at least two successive boot sizes, whereby said lateral zones of said vamp are at least partially overlapped with said lateral zones of said cradle;

said vamp including deformation zones positioned in said plantar support of said vamp, said deformation zones, comprised of said second material of which said vamp is comprised, being adapted to deform transversely during said nesting of said vamp and said cradle, comprised of said first material, in said determinate position.

11. A boot according to claim 10, wherein:

said sole of said cradle is an external sole adapted to be affixed to a gliding device.

12. A boot according to claim 11, in combination with said gliding device affixed to said external sole.

13. A boot according to claim 12, wherein:

said gliding device comprises a frame and a plurality of wheels rotatably affixed to said frame, said frame being affixed to said external sole.

14. A boot according to claim 10, wherein:

said deformation zones are constituted by generally longitudinally extending slots near lateral edges of said plantar support of said vamp, allowing transverse elastic deformation upon nesting of said vamp within said cradle.

15. A boot according to claim 10, wherein:

said vamp has a rear end and said rear envelope of said cradle has an internal edge;

a clearance is provided between said rear end of said vamp and said internal edge of said rear envelope of said cradle in a longer one of said at least two successive boot sizes; and said clearance is eliminated between said rear end of said vamp and said internal edge of said rear envelope of said cradle in a shorter one of said at least two successive boot sizes.

16. A boot according to claim 10, further comprising:

means for connecting said vamp and said cradle in said determinate position.

17. A boot according to claim 16, wherein:

said means for connecting comprises glue.

18. A boot according to claim 16, wherein:

said means for connecting comprises weld seams.

19. A boot according to claim 16, wherein:

said means for connecting comprises stitches.

20. A boot according to claim 16, wherein:

said means for connecting comprises:

elongated slots in at least one of said vamp and said cradle;

openings in at least one of said vamp and said cradle; and rivets extending through respective ones of said slots and said openings to secure said vamp to said cradle in said determinate position.

21. A skate comprising:

a frame;

at least one gliding member attached to said frame; and a boot attached on said frame, said boot comprising:

an external sole adapted to be affixed to a gliding member;

an upper extending upwardly from said sole for covering a user's foot;

said external sole and said upper comprising a first part comprising a first material and a second part comprising a second material, said first material being more rigid than said second material, said second material being more flexible than said first material;

said first part, constituting a cradle, forming a rear envelope to house the user's heel and extending forwardly to constitute said sole;

said second part, constituting a vamp, including a portion to cover the user's forefoot and a plantar support;

said vamp being nested with said cradle in a determinate position between at least two positions corresponding to at least two successive boot sizes;

a connection arrangement to connect said vamp to said cradle in said determinate position; and said vamp including deformation zones positioned in said plantar support of said vamp, said deformation zones, comprised of said second material, being adapted to deform during said nesting of said vamp with said cradle, comprised of said first material, in said determinate position.

22. A skate according to claim 21, wherein:

said at least one gliding member comprises a plurality of wheels.

* * * * *